US011098527B2

(12) United States Patent
Barker

(10) Patent No.: US 11,098,527 B2
(45) Date of Patent: Aug. 24, 2021

(54) CONCEALED DOOR ASSEMBLY HAVING HINGEDLY-AFFIXED EXTERIOR SHELVING AND COMPONENTS

(71) Applicant: Jeremy Barker, Morgan, UT (US)

(72) Inventor: Jeremy Barker, Morgan, UT (US)

( * ) Notice: Subject to any disclaimer, the term of this patent is extended or adjusted under 35 U.S.C. 154(b) by 0 days.

(21) Appl. No.: 15/899,136

(22) Filed: Feb. 19, 2018

(65) Prior Publication Data

US 2019/0254429 A1 Aug. 22, 2019

(51) Int. Cl.

| | |
|---|---|
| ***E06B 7/34*** | (2006.01) |
| ***A47B 96/16*** | (2006.01) |
| ***E06B 5/10*** | (2006.01) |
| ***E05D 7/081*** | (2006.01) |

(52) U.S. Cl.

CPC ..... *E06B 7/34* (2013.01); *A47B 96/16* (2013.01); *E05D 7/081* (2013.01); *E06B 5/10* (2013.01); *E05Y 2600/41* (2013.01); *E05Y 2900/20* (2013.01)

(58) Field of Classification Search

CPC ..... A47B 96/16; E06B 7/34

See application file for complete search history.

(56) References Cited

U.S. PATENT DOCUMENTS

| | | | | |
|---|---|---|---|---|
| 750,193 | A * | 1/1904 | James | A47B 51/00 312/242 |
| 2,403,246 | A * | 7/1946 | Sperling | E06B 3/00 160/107 |
| 2,808,610 | A * | 10/1957 | Minor | E05D 3/04 16/365 |
| 3,048,898 | A * | 8/1962 | Davis | E05D 15/50 16/230 |
| 3,216,774 | A * | 11/1965 | Figurski | A47B 81/00 312/140.2 |
| 4,813,181 | A * | 3/1989 | Torabi | E05D 15/50 312/291 |
| 6,220,681 | B1 * | 4/2001 | Swensson | A47B 5/00 312/238 |
| 6,457,278 | B1 * | 10/2002 | Fleming | A47B 46/00 312/249.7 |
| 6,652,049 | B1 * | 11/2003 | Tyner | E06B 7/34 312/321.5 |
| 8,777,339 | B2 * | 7/2014 | Tassin | E06B 7/34 312/249.2 |
| 9,609,947 | B1 * | 4/2017 | Tassin | A47B 47/03 |
| 2014/0327350 | A1 * | 11/2014 | Tassin | A47B 46/00 312/249.7 |

FOREIGN PATENT DOCUMENTS

| | | | | |
|---|---|---|---|---|
| DE | 202013000079 | U1 * | 2/2013 | E06B 7/34 |

* cited by examiner

*Primary Examiner* — Catherine A Kelly
(74) *Attorney, Agent, or Firm* — Steven Rinehart

(57) ABSTRACT

A concealed door hingedly-affixed to a concealed door frame adapted to resemble shelving and cabinets, the concealed door assembly simulated permanently-affixed shelving and cabinets, and comprising a playless hinge and various overlapping, double-stacked and interconnected components.

4 Claims, 4 Drawing Sheets

CONCEALED DOOR ASSEMBLY HAVING HINGEDLY-AFFIXED EXTERIOR SHELVING AND COMPONENTS

BACKGROUND OF THE INVENTION

Field of the Invention

This invention relates to door assemblies and more particularly relates to concealed doors disguised behind cabinets and shelving.

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Concealed doors and doorways to prevent unauthorized entry have been known in the art, but with little attempt to stylize forward surfacing or minimize the appearance concealing hardware. While some of the apparti in the art have been considered satisfactory there remains a need in the art for concealed door assemblies which do not detract from the appearance of the door entryway with artificial concealed hardware and which thus mesh more realistically with surrounding fixtures. Additionally, Traditional concealed doorways have weak structural integrity and unrealistic fixtures. Traditional concealed doorways do not offer optimal approaches to dampening the periodic motions and abrasive wear on the hinge, resulting in failure of the hinge, sagging concealed fixtures, abrasion in floor surfacing in front of the concealing hardware revealing S the existence of the doorway, and other inefficiencies. Traditional doorways are not perfect and leave room for more optimal stylistic and functional properties.

It is desirable to provide to the modern stylistic and more durable concealed doorway with modularized components suitable to meet a variety of stylistic, aesthetic and functional needs and preferences, which makes use of improved manufacturing and design technologies.

SUMMARY OF THE INVENTION

From the foregoing discussion, it should be apparent that a need exists for a concealed door assembly. Beneficially, such an apparatus would overcome many of the difficulties of the prior art by providing a durable, fully-concealed door assembly.

The present invention has been developed in response to the present state of the art, and in particular, in response to the problems and needs in the art that have not yet been fully solved by currently available apparati and methods. Accordingly, the present invention has been developed to provide a concealed door assembly comprising: a door frame comprising: a sill comprising a latch recess; a doorjamb; a frame post; a lintel; a door comprising: two or more vertical posts; an upper beam; a lower beam; a plurality of shelves; two or more doors; a latching mechanism; a concealing post affixed to a forward surface of vertical post jutting laterally from the vertical post, the concealing post adapted to hide the frame post from a forward perspective view; wherein three or more of the sill, door jamb, frame post, lintel, vertical posts, upper beam and lower beam are double-stacked; and wherein the door is hingedly-affixed to the door frame using a first hinge and a second hinge, the first hinge hingedly connecting the upper beam and the lintel, the second hinge hingedly connecting the lower beam and the sill.

The lintel may protrude downwardly in front of the frame post hiding a connection point between the frame post and the lintel.

Each of the two or more doors may be hingedly connected to a vertical post.

The latching mechanism may be affixed to a vertical post behind the concealing post from a forward perspective view.

A second concealed door assembly is provided comprising: a door frame comprising: a sill comprising a latch recess; a door jamb; a frame post; an L-shaped lintel adapted to conceal a connection point between the frame post and the lintel; a door comprising: two or more vertical posts; an upper beam; a lower beam; a plurality of shelves; two or more doors, each door hingedly connected to a vertical post; a latching mechanism affixed to a vertical post; a concealing post affixed to a forward surface of vertical post jutting laterally from the vertical post, the concealing post adapted to hide the frame post from a forward perspective view; wherein five or more of the sill, door jamb, frame post, lintel, vertical posts, upper beam and lower beam are double-stacked; and wherein the door is hingedly affixed to the door frame using a first hinge and a second hinge, the first hinge hingedly connecting the upper beam and the lintel, the second hinge hingedly connecting the lower beam and the sill.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
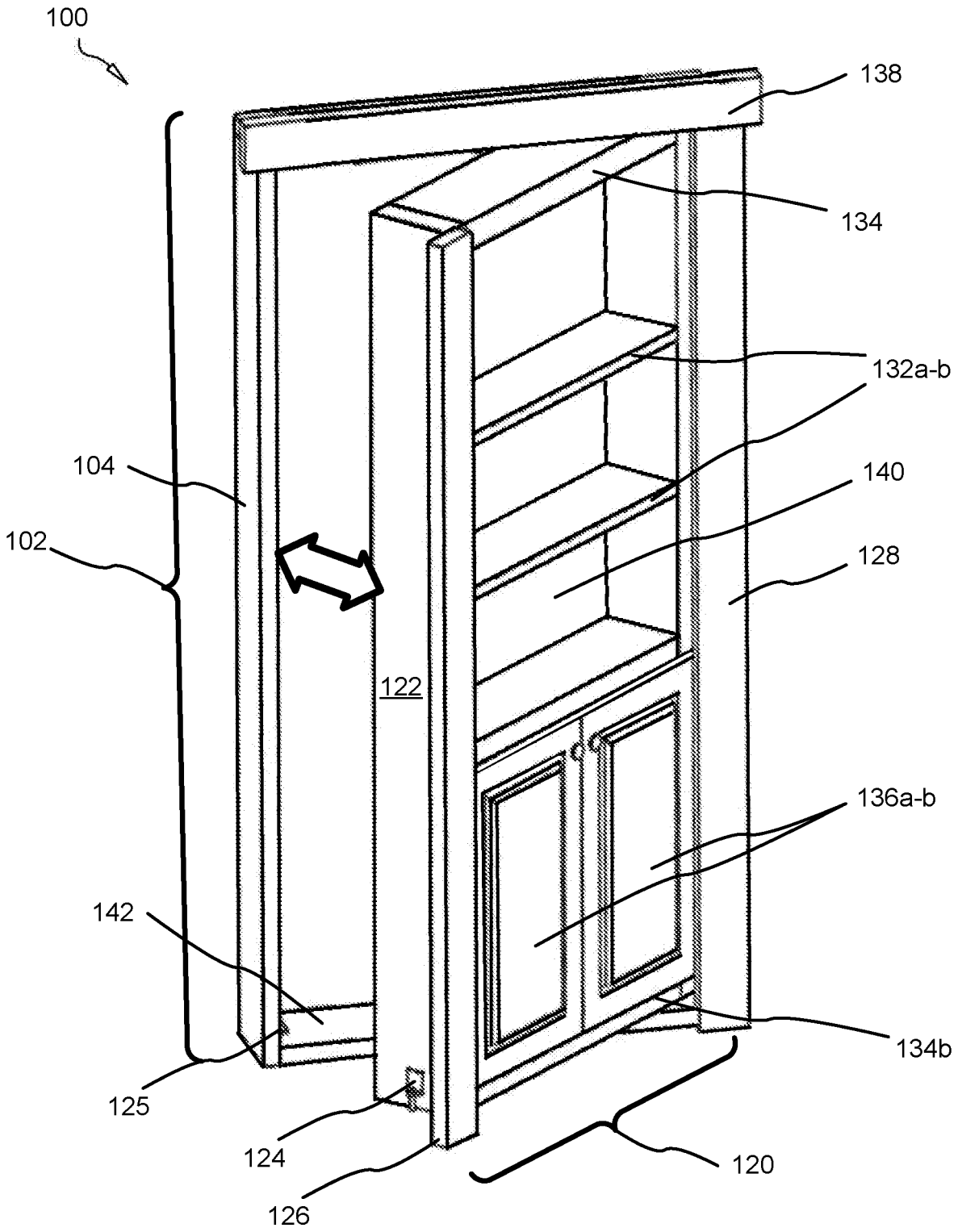
FIG. 1 is a forward perspective view of partially open concealed door assembly in accordance with the present invention.

FIG. 1 is a forward perspective view of partially open concealed door assembly 100 in accordance with the present invention. The concealed door assembly 100 comprises a concealed door 120 and a door frame 102.

The door frame 102 comprises a lintel 138, a door jamb 128, a frame post 104 and a latch recess 125. The latch recess 125 is defined by sill 142 for receiving a latch pin forming a latching mechanism 124, the latching mechanism 124 affixed to a door post 122.

The lintel 138 overlays an upper edge of the frame post 104 and doorjamb 128 such that the lintel 128 in combination with the concealing post 126 concealing the existence of the door 120 within the door frame 102. The lintel 138 provided is disposed above the concealed door 120 and partially overlaying the top surface of the concealed door 120. In various embodiments, the lintel 138 is L-shaped such that is rests and is affixed to a frame post 104 and a door jamb while also concealing the connection point between the lintel 138 and frame post 104.

The door 120 positions within the door frame 102 such that each exterior edge of the door 120 is substantially flush with an inner edge of the door frame 102.

The door 120 comprises a square or rectangular door panel 140 having a top edge and bottom edge. The door panel 140 can be formed from polymeric, metallic and/or organic materials including wood, wood paneling, plywood, particle board and the like (including even leather). The door panel 140 has planar forward surface and planer rearward surfaces and may be finished with varnish or using other means known to those of skill in the art.

The door 120 comprises two posts 122 interconnected by two beams 134. Each of the beams 134 is hingedly connected to one of the lintel 138 and the sill 142 using a flush mount hinge recessed into an interior surface of one or more of the lintel 138, the sill 142, and the beams 134. The door 120 provided herein differs inter alia from other doors in art in that the door 120 is not hingedly connected to a doorjamb but rather to the lintel 138 and the sill 142.

The upper beam 134 (also a top rail 134) defines a downwardly opening channel for receiving a top edge of door panel 140. Likewise the lower beam 134 defines an upwardly opening channel for receiving a lower edge of the door panel 140.

A plurality of shelves 132*a-b* are affixed between the door posts 122. Cabinet doors 136*a-b* are hingedly affixed to the door posts 122 and positioned below the shelves 132*a-b*.

The door 120 swings axially inward and outward on the flush hinges as shown.

Figure 2:
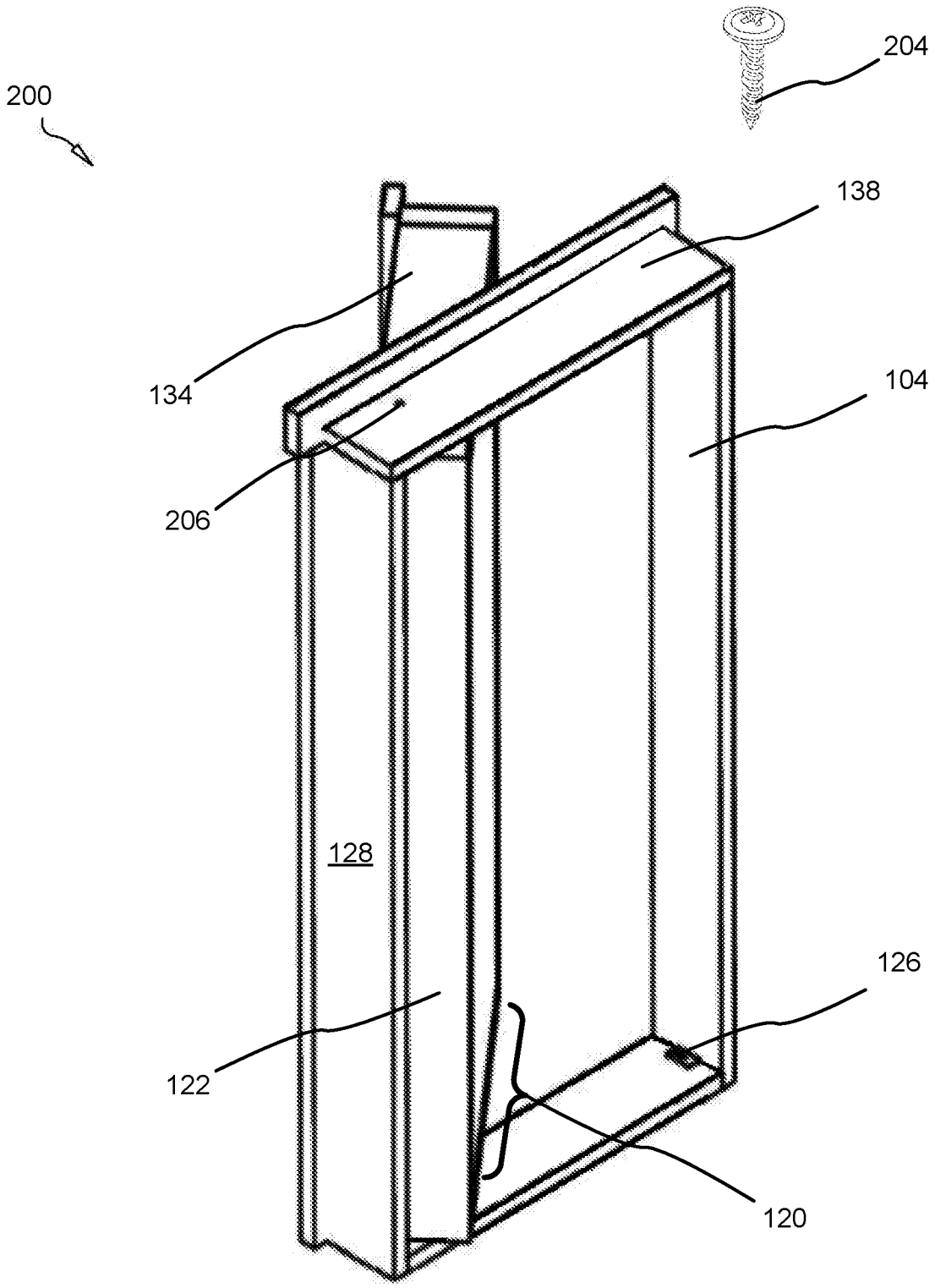
FIG. 2 is a rearward perspective view of partially open concealed door assembly in accordance with the present invention.

FIG. 2 is a rearward perspective view of partially open concealed door assembly 200 in accordance with the present invention.

Each of the components of the door frame 102 and the door 120 are screwed together using a plurality of screw 204 as shown. These screws 204 may comprise ½ inch back screws. Additionally, each of the components of the door frame 102 and door 120 are glued, or adhered, together using wood glue.

The flush cut hinge 206 is indicated 206. The hinge 206 is recessed into the upper beam 134, sill 142, and or lintel 138 at a distance from the lateral side predetermined to allow free axial rotation of the door 120 within the door frame 102. In various embodiments, the hinge 206 is rating to withstand up to 300 pounds of weight on the shelving 132. In various other embodiments, the hardware (or components) forming the shelving 132 is rated to withstand 1,100 pounds or more in weight.

The upper beam 134, the sill 142, and the other components of the assembly 200 may comprise ¾ inch wooden planks. The upper beam 134 when positioned at the bottom of the door 120 is a lower beam 134*b*.

Figure 3:
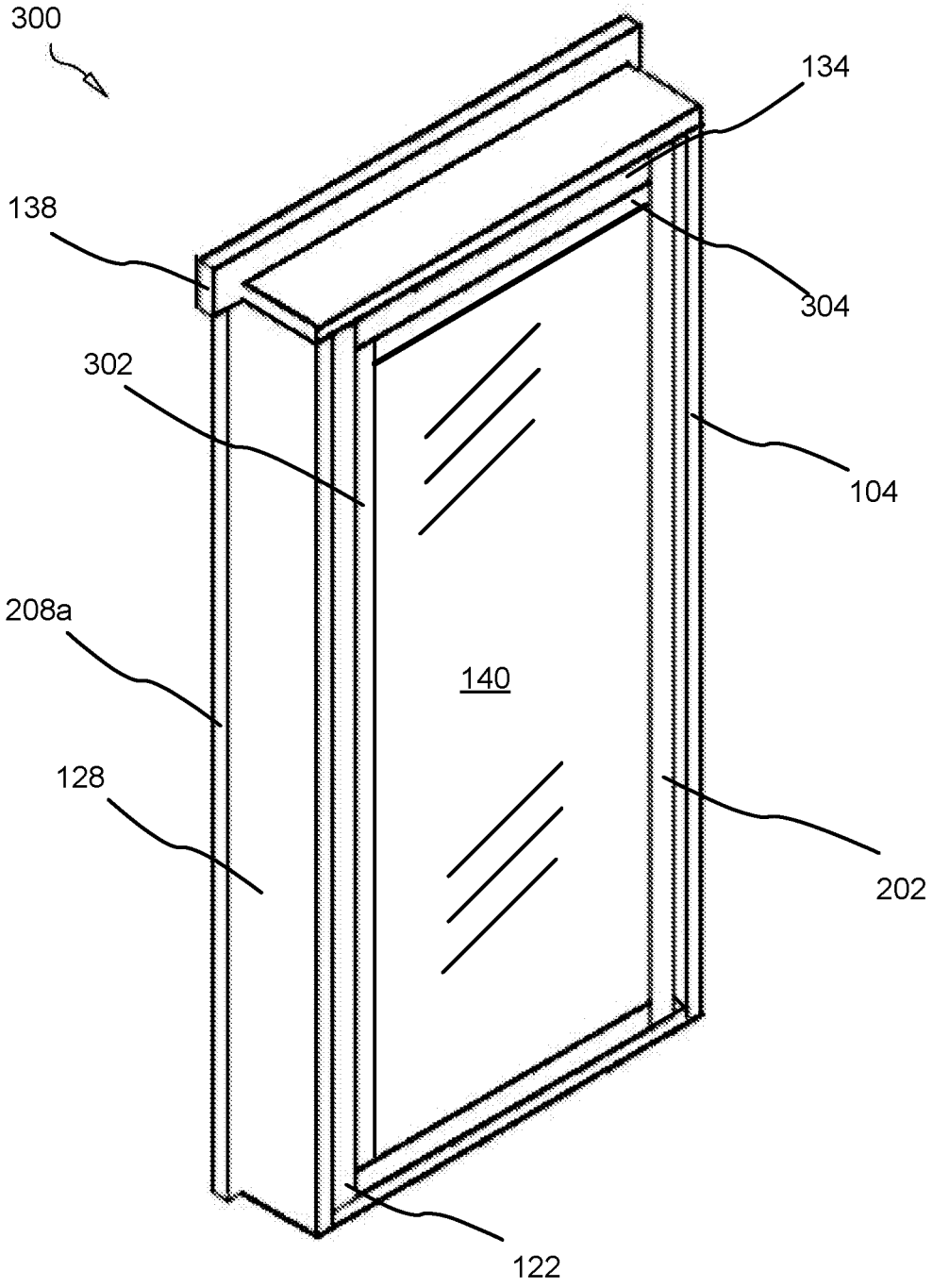
FIG. 3 is a rearward perspective view of closed concealed door assembly in accordance with the present invention.

FIG. 3 is a rearward perspective view of closed concealed door assembly 300 in accordance with the present invention.

Each of the wooden components of the assembly 300 may be double-stacked as shown. The door assembly 300 comprises a ¾ inch thick upper beam 134 which is reinforced with a second ¾ inch upper beam 304 (or which is double-stacked). The second ¾ inch upper beam 304 is adhered using wood glue to the upper beam 134 and is screwed thereto. Likewise, the post 122 is reinforced with a second post 302 which is likewise adhered and screwed to the post 122. The second upper beam 304 abuts the second post 302 rather than the post 128. The sill 142, the post 202, the lintel 128, and other components may all also likewise be reinforced, or double-stacked to increase maximum weight ratings for the assembly 300.

Figure 4:
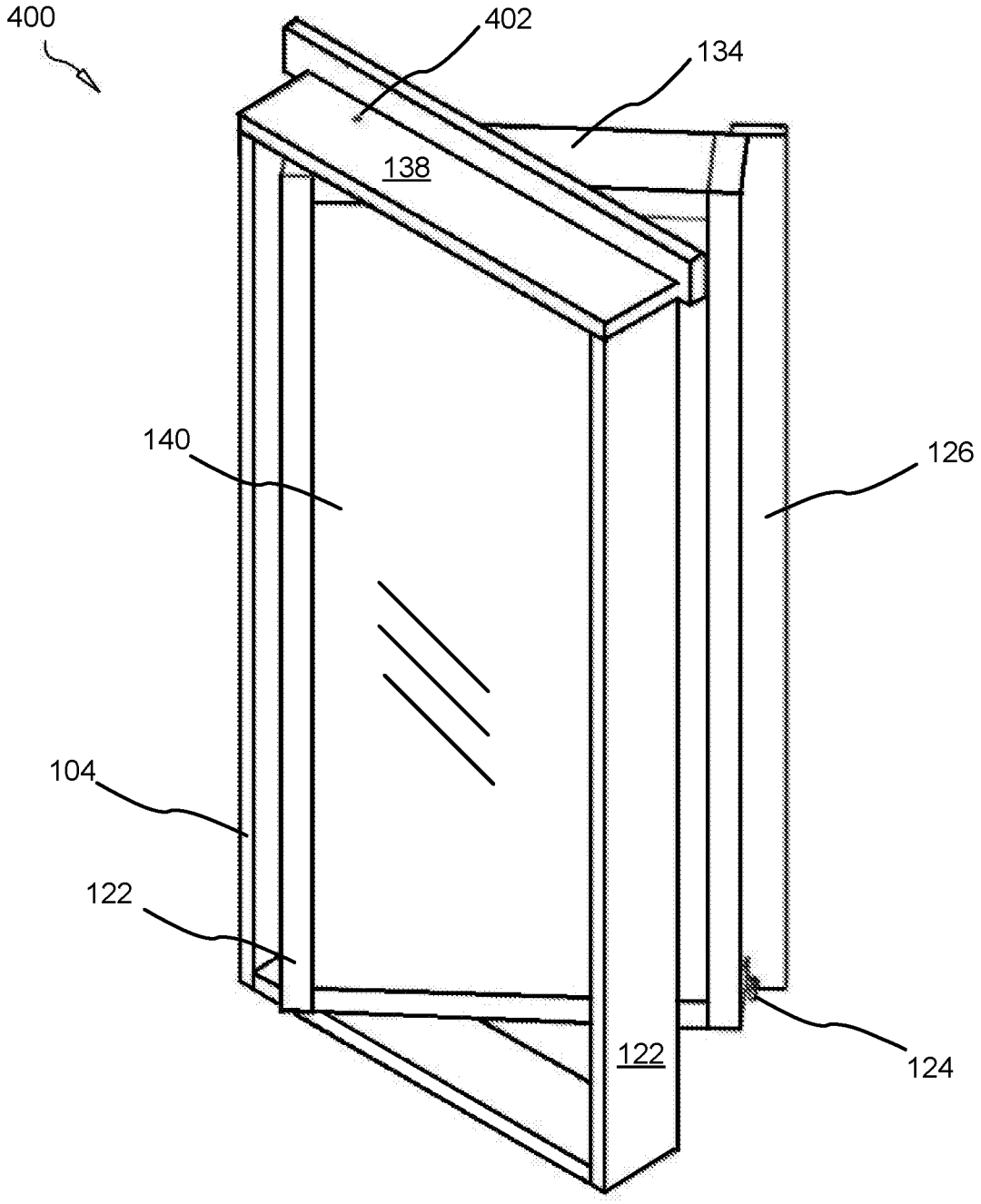
FIG. 4 is a rearward perspective view of partially open concealed door assembly in accordance with the present invention.

FIG. 4 is a rearward perspective view of partially open concealed door assembly 400 in accordance with the present invention.

The hinge 206 disposed at the top of the door 120 is the upper hinge 402 while the hinge 206 disposed at the bottom of the door 120 is the lower hinge.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A concealed door assembly comprising:

a door frame comprising:

a sill comprising a latch recess adapted to receive a latch pin;

a doorjamb;

a frame post;

an L-shaped lintel overlaying an upper edge of the frame post wherein the lintel partially overlaps a top surface of a door;

the door hingedly affixed to the lintel and to the sill but not to the door jamb comprising:

three or more vertical posts, wherein two or more of the three of more vertical posts are screwed together using glue and screws;

a first upper beam hingedly connected to the lintel, the upper beam being ¾ inch thick;

a second upper beam adhered to and beneath the first upper beam, the second upper beam narrower in width than the first upper beam, the second upper beam abutting two of the three vertical posts;

a lower beam hingedly connected to the sill;

a plurality of shelves glued and screwed to the door posts;

two or more doors wherein at least one of the two or more doors is affixed to a vertical post abutting the second upper beam;

the latch pin affixed to a vertical post behind a concealing post;

the concealing post affixed to a forward surface of a vertical post jutting laterally from the vertical post, the concealing post adapted to hide the frame post from a forward perspective view;

wherein as the door swings forwardly a portion of the door swings rearwardly;

wherein the vertical posts, upper beam and lower beam are each double-stacked; and wherein the door is hingedly affixed using a first flush hinge and a second flush hinge, the first flush hinge hingedly connecting the upper beam and the lintel, the second flush hinge hingedly connecting the lower beam and the sill.

2. The concealed doorway of claim 1, wherein the lintel protrudes downwardly in front of the frame post hiding a connection point between the frame post and the lintel.

3. The concealed doorway of claim 1, wherein each of the two or more doors are hingedly connected to a respective one of the three or more vertical posts.

4. The concealed doorway of claim 1, wherein the latch pin in affixed to a one of the three or more vertical posts behind the concealing post from a forward perspective view.

* * * * *